US007713040B2

(12) United States Patent
Kimura et al.

(10) Patent No.: US 7,713,040 B2
(45) Date of Patent: May 11, 2010

(54) ROTOR SHAFT SEALING METHOD AND STRUCTURE OF OIL-FREE ROTARY COMPRESSOR

(75) Inventors: Hideyuki Kimura, Kawasaki (JP); Masami Muto, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 12/058,831

(22) Filed: Mar. 31, 2008

(65) Prior Publication Data

US 2008/0240965 A1 Oct. 2, 2008

(30) Foreign Application Priority Data

Mar. 30, 2007 (JP) ..... 2007-095583

(51) Int. Cl.
*F01C 19/00* (2006.01)
*F03C 2/00* (2006.01)

(52) U.S. Cl. ..... 418/104; 418/141; 418/201.1; 277/431; 277/304; 277/361

(58) Field of Classification Search ..... 418/206.1, 418/201.1, 104, 141; 277/304, 306, 361, 277/431

See application file for complete search history.

(56) References Cited

U.S. PATENT DOCUMENTS

| | | | |
|---|---|---|---|
| 2,937,039 | A | 5/1960 | Santapa |
| 2,948,555 | A | 8/1960 | Wright |
| 3,975,123 | A | 8/1976 | Schibbye |
| 4,487,563 | A | 12/1984 | Mori et al. |
| 4,781,553 | A | 11/1988 | Nomura et al. |
| 5,014,999 | A | 5/1991 | Makhobey |

(Continued)

FOREIGN PATENT DOCUMENTS

| | | | |
|---|---|---|---|
| BE | 1010821 | A3 | 2/1999 |

(Continued)

OTHER PUBLICATIONS

Related co-pending U.S. Appl. No. 12/058,821; Hideyuki Kimura et al.; "Rotor Shaft Sealing Structure of Oil-Free Rotary Compressor"; filing date Mar. 31, 2008; Spec. pp. 1-20; Figs. 1-5d.

(Continued)

*Primary Examiner*—Theresa Trieu
(74) *Attorney, Agent, or Firm*—Rossi, Kimms & McDowell LLP

(57) ABSTRACT

A rotor shaft sealing method for an oil-free rotary compressor is provided, with which occurrence of lubrication oil intrusion into the compression chamber of the compressor which is liable to occur when negative pressure is produced in the compression chamber, is prevented. With a rotor shaft sealing structure composed such that two shaft seal means are provided in the rotor casing between the oil lubricated bearing and the compression chamber such that an annular airspace is formed between the two shaft seal means, at least one communicating hole is provided to communicate the annular airspace to the outside of the rotor casing, and the annular airspace of the male rotor shaft sealing part and the annular airspace of the female rotor shaft sealing part are connected by a between-rotor shaft communication passage, pressurized air is supplied to the annular airspaces by which lubrication oil intrusion into the compression chamber is prevented.

2 Claims, 5 Drawing Sheets

U.S. PATENT DOCUMENTS

| | | | | |
|---|---|---|---|---|
| 5,364,250 | A | 11/1994 | Aoki et al. | |
| 5,641,280 | A * | 6/1997 | Timuska | 418/102 |
| 6,095,780 | A | 8/2000 | Ernens | |
| 6,471,492 | B2 * | 10/2002 | Nishimura et al. | 418/201.1 |
| 2005/0084404 | A1 * | 4/2005 | Okada et al. | 418/104 |
| 2005/0147517 | A1 | 7/2005 | Dreifert et al. | |

FOREIGN PATENT DOCUMENTS

| | | | |
|---|---|---|---|
| DE | 19544994 | A1 | 6/1997 |
| EP | 0859154 | A1 | 8/1998 |
| JP | 59110889 | A | 6/1984 |
| JP | 62210282 | A | 9/1987 |
| JP | 3-110138 | U | 11/1991 |
| JP | 7-317553 | A | 12/1995 |
| JP | 10103265 | A | 4/1998 |
| JP | 11-294599 | A | 10/1999 |
| JP | 2002276574 | A | 9/2002 |
| JP | 2005-54614 | A | 3/2005 |
| WO | 9415100 | A1 | 7/1994 |

OTHER PUBLICATIONS

Related co-pending U.S. Appl. No. 12/058,852; Hideyuki Kimura et al.; "Shaft Seal Device for Oil-Free Rotary Compressor"; filing date Mar. 31, 2008; Spec. pp. 1-12; Figs. 1-6.

Extended search report, dated Jul. 18, 2008, issued in EP application No. 08004696.4-1267 which corresponds to related co-pending U.S. Appl. No. 12/058,821.

Extended search report issued in corresponding EP patent appl. No. 08004695.6-1267 dated Jul. 18, 2008.

* cited by examiner

A-A Sectional View

FIG. 6a
*Prior Art*
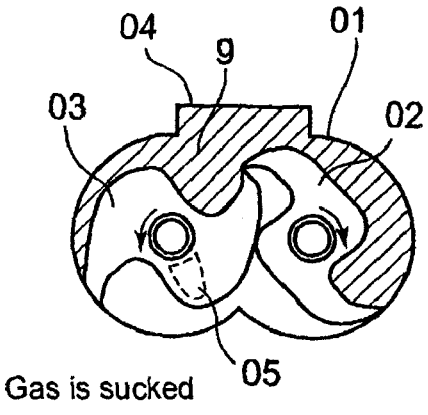
FIG. 6b
*Prior Art*
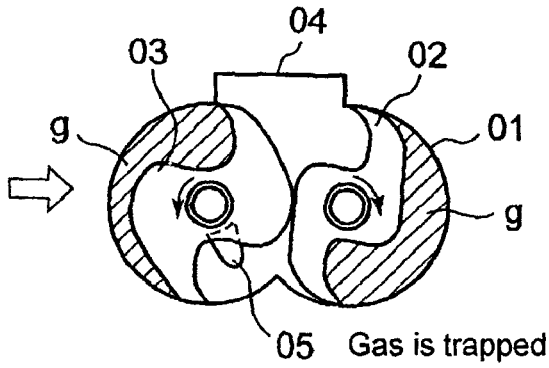
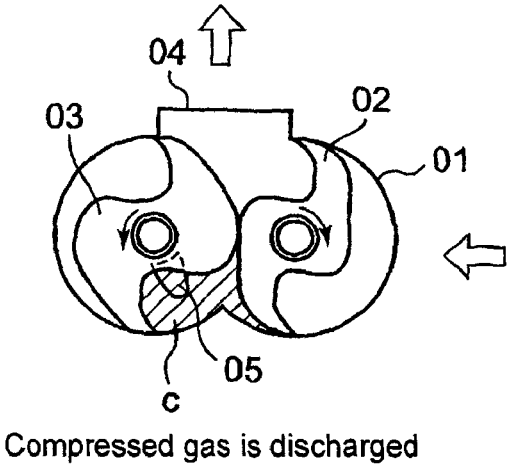
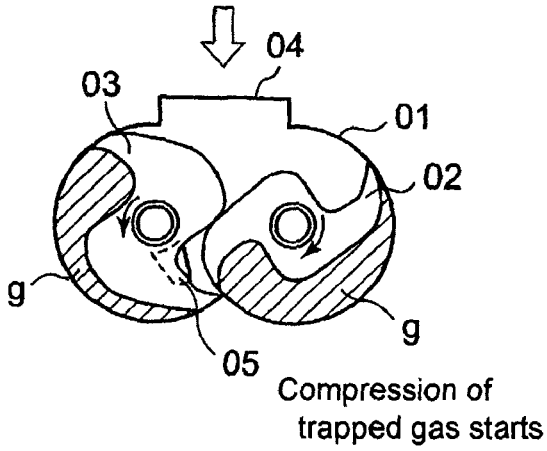
FIG. 6d
*Prior Art*
FIG. 6c
*Prior Art*

ROTOR SHAFT SEALING METHOD AND STRUCTURE OF OIL-FREE ROTARY COMPRESSOR

BACKGROUND OF THE INVENTION

1. Field of the Invention

The present invention relates to a rotor shaft sealing method and structure of an oil-free rotary compressor such as a tooth type rotary compressor, whose sealing structure can prevent lubrication oil of the drive mechanism of the rotor from leaking into the compression chamber of the compressor even when the pressure of the compression chamber becomes lower than atmospheric pressure, which occurs under some operation condition of the compressor.

2. Description of the Related Art

Generally, a tooth type rotary compressor consists of two rotors, a male rotor and a female rotor, each having claw-like teeth, or lobes. The rotors turn in opposite directions without contact to each other to compress gas trapped in the compression pockets formed between the lobes and inner surface of a compressor casing as the rotors rotate. As the rotors do not contact with each other and with the inner surface of the compressor casing, the rotors do not wear and have a long life. Further, lubrication of the rotors is not needed because of non-contact engagement of the rotors, and clean compressed gas not contaminated with lubricant can be obtained. Compression ratio obtained by this type of compressor is relatively low, and required high compression ratio is obtained with high efficiency in many cases by composing a two-stage compressor unit comprised of a lower pressure stage compressor and a higher pressure stage compressor connected in series and driven separately. Working of the tooth type compressor will be explained hereunder referring to FIG. 6*a* to FIG. 6*d*

In FIG. 6*a*, a male rotor 02 having claw-like lobes engages with a female rotor 03 having claw-like lobes with very tight clearances in a compressor housing 01. Gas g to be compressed is sucked from a suction opening 04 into the compressing chamber as the rotors 02 and 03 rotate in directions indicated by arrows. In FIG. 6*b*, the suction opening 04 is closed by the rotors 02, 03, and the sucked gas g is confined in a pocket surrounding the lobes of the female rotor 03 and in a pocket surrounding the lobes of the male rotor 02. The rotors convey the gases confined, or trapped in the pockets from the suction side to the pressure side as shown in FIG. 6*c*, where the pockets are communicated and the volume of the sum of the two pockets reduces as the rotors rotate and the gases are compressed until the female rotor 03 uncovers the discharge port 05. In FIG. 6*d*, the discharge port 05 is uncovered by the female rotor 03 and the compressed gas c between the rotors is discharged through the discharge port 05.

It is necessary requirement for an oil-free rotary compressor such as an oil-free tooth type compressor that lubrication oil for lubricating rotor shaft bearings is prevented from leaking into the compression chamber of the compressor in order to supply clean compressed gas not containing the lubrication oil. Positive pressure is produced in the compression chamber in load operation of the compressor, but when the compressor is operated under no load, pressure in the compression chamber becomes negative, for the upstream side of the suction port of the compressor is shut by a suction closing mechanism. When pressure in the compression chamber becomes negative, intrusion of lubrication oil supplied to the rotor bearing into the compression chamber through the shaft seal may occur.

Rotor shaft sealing structure of a screw compressor type supercharger is disclosed in Japanese Laid-Open Utility Model Application No. 3-110138 (hereinafter "JP 3-110138"). The sealing structure is composed such that a lip seal (contact seal) and a non-contact seal are located between rotor shaft bearing and the compression chamber, an airspace is formed between both the seals, a communicating passage is provided to allow the airspace to communicate with outside air, and a check valve is provided in the communicating passage to allow outside air to be sucked into the airspace when negative pressure is produced in the airspace.

With the above-described construction, pressure difference between the compression chamber and the airspace is reduced through the non-contact seal having fin-like annular protrusions such as a labyrinth seal. When pressure in the compression chamber is positive, higher than atmospheric pressure, escaping of the positive pressure air in the compression chamber passing through the communicating passage is prevented by the check valve closed by positive pressure in the communicating passage, and when pressure in the compression chamber is negative, the check valve is opened by negative pressure in the communicating passage and outside air is sucked into the air space, thus the airspace serves as a pressure equalizer room. In this way, intrusion of the lubrication oil into the compression chamber is prevented by maintaining the airspace not lower in pressure than that in the bearing part.

A rotor shaft sealing structure disclosed in Japanese Laid-Open Patent Application No. 7-317553 (hereinafter "JP 7-317553") relates also to shaft sealing structure of a screw compressor type supercharger. The shaft sealing structure is composed such that a contact seal (lip seal, for example) for sealing lubrication oil lubricating the rotor shaft bearing and a pressure fluctuation alleviating member (a piston ring movable in axial direction, for example) are located between rotor shaft bearing and the compression chamber, an airspace which serves as a pressure equalizer room is formed between the contact seal and the pressure fluctuation alleviating member, and a communicating passage opened into outside of the compressor.

However, with the sealing structure disclosed in the JP 3-110138, in a case where leakage of lubrication oil occurs from the bearing part to the airspace through the lip seal, oil leaked to the airspace is difficult to escape outside because of the presence of the check valve in the communicating passage. When pressure in the compression chamber becomes negative while the leaked lubrication oil is present in the airspace, the lubrication oil residing in the airspace is apt to be ingested into the compression chamber.

Further, in a case where the communicating passage is clogged for any reason, the leaked lubrication oil accumulates in the airspace without being allowed to escape outside, and the leaked lubrication oil accumulated in the airspace is easily ingested into the compression chamber when negative pressure is produced in the compression chamber.

According to the sealing structure disclosed in the JP 7-317553, the communicating passage for communicating the airspace surrounding the rotor shaft to the outside of the compressor is not provided with a check valve. However, a means for allowing lubrication oil leaked into the airspace to escape outside in a convincing way is also not disclosed in JP 7-317553. Further, a means for allowing lubrication oil accumulated in the airspace when the communicating passage is clogged to escape outside is not disclosed in either JP 3-110138 or JP 7-317553. Further, in the above references, the rotor shaft sealing structure is composed such that atmospheric air can be introduced into the airspace as a pressure equalized room, however, sealing effect will be increased by introducing air pressurized to a pressure higher than atmospheric pressure to the pressure equalized room.

SUMMARY OF THE INVENTION

The present invention was made in light of the problems of the prior arts, and the object of the invention is to provide a rotor shaft sealing method and structure for an oil-free rotary compressor, with which occurrence of lubrication oil intrusion into the compression chamber of the compressor which is liable to occur when negative pressure is produced in the compression chamber, is prevented, and even if lubrication oil leaks through the bearing side oil seal toward the annular airspace of the shaft sealing part, the leaked lubrication oil is exhausted to the outside of the compressor casing and prevented from intruding into the compression chamber.

To attain the object, the present invention proposes a rotor shaft sealing method for an oil-free rotary compressor having a pair of male and female rotors accommodated in a compression chamber formed by a rotor casing, each rotor having a rotor shaft extending from both end faces of the rotor to penetrate both side walls of the rotor casing to be supported by the rotor casing via oil lubricated bearings by both the side walls of the rotor casing, in which a rotor shaft sealing part comprising two shaft seal means is provided to each of rotor shaft bearing parts between the bearing and the compression chamber such that an annular airspace is formed between the shaft seal means, and pressurized air is supplied to the annular airspace of each of the shaft sealing parts, thereby preventing intrusion of lubrication oil into the compression chamber when operating the rotary compressor.

The invention proposes as a rotor shaft sealing structure for applying the method a rotor shaft sealing structure of an oil-free rotary compressor having a pair of male and female rotors accommodated in a compression chamber formed by a rotor casing, each rotor having a rotor shaft extending from both end faces of the rotor to penetrate both side walls of the rotor casing to be supported by the rotor casing via oil lubricated bearings by both the side walls of the rotor casing, which includes a rotor shaft sealing part comprising two shaft seal means provided to each of rotor shaft bearing parts between the bearing and the compression chamber such that an annular airspace is formed between the shaft seal means, and a pressurized air supplier for supplying pressurized air to each of the annular airspace.

According to the rotor shaft sealing structure of the invention, pressurized air is supplied to the annular airspace formed between the seal means adjacent the oil lubricated bearing and the seal means adjacent the compression chamber. In load operation of the compressor, pressure in the compression chamber is higher than atmospheric pressure and compressed air in the compression chamber may leak slightly toward the annular airspace through the shaft seal means located adjacent the compression chamber. However, as the pressurized air flows through the annular airspace, pressure in the annular airspace is raised and leak of the compressed air to the annular airspace is reduced. The air leaked to the annular airspace flows out through the communicating hole to the outside of the rotor casing together with the pressurized air. Therefore, even if lubrication oil leaks through the oil seal means located adjacent the rotor shaft bearing to the annular airspace, the lubrication oil leaked to the annular airspace is taken away by the pressurized air to the outside of the rotor casing, such that there is no fear that the lubrication oil intrudes into the compression chamber.

When the compressor is operated at no load, suction path of the compressor is shut-off and negative pressure is produced in the compressor chamber. Air in the annular airspace may be ingested through the sealing means locates adjacent the compression chamber thereinto. However, pressurized air is supplied to the annular airspace which is communicated to the outside of the rotor casing and maintained at atmospheric pressure, so there is little fear that lubrication oil leaks through the shaft seal means located adjacent the bearing and intrudes into the combustion chamber.

As pressurized air is supplied to the annular airspace as mentioned above, the annular airspace is maintained at a pressure higher than atmospheric pressure, and propagation of negative pressure produced in the compression chamber to the bearing side seal means is prevented and lubrication oil in the oil lubricated bearing is prevented from being ingested into the compression chamber of the compressor. The method of the invention is particularly effective when the compressor is operated at no-load at which negative pressure is produced in the compression chamber.

In the method, it is preferable that lubrication oil leaked from the bearing to the annular airspace is exhausted to the outside of the rotor casing through a communicating hole which opens at a bottom part of the annular airspace to communicate the annular airspace to the outside of the rotor casing. Even if lubrication oil leaks from the bearing to the annular airspace, it is taken out to the outside of the rotor casing, resulting in that the leaked lubrication oil is prevented from intruding into the compression chamber.

As a shaft sealing structure, it is suitable to composed the structure such that at least one communicating hole for communicating each annual airspace to the outside of the rotor casing is provided such that it opens at a bottom part of the annular airspace to communicate the annular airspace to the outside of the rotor casing, and that each of the annular airspaces of the male rotor shaft sealing parts and each of those of the female rotor shaft sealing parts are connected by a between-rotor shaft communication passage respectively so that pressurized air supplied to each annular airspace of one of the rotor shaft sealing parts is supplied to each annular airspace of the other rotor shaft sealing part.

As the between-rotor shaft communication passage is provided to connect between the annular airspaces of the male and female rotor shaft sealing parts, even if the communicating hole communicating the annular airspace of the rotor shaft sealing part of one of the rotor shaft bearing part to the outside of the rotor casing is clogged, pressurized air can flow through the communicating hole communicating the annular airspace of the rotor shaft sealing part of the other rotor shaft bearing part to the outside of the rotor casing, and leaked lubrication oil to any of the annular airspaces can be taken away by the pressurized air.

By forming pressurized air passages connecting to the between-rotor shaft communication passages respectively in the rotor casing in order to supply pressurized air to the annular airspaces, pressurized air is supplied to the annular airspaces via the passages and between-rotor shaft communication passages.

According to the rotor shaft sealing method and structure of the invention, rotor shaft sealing structure of an oil-free rotary compressor is provided with which risk of occurrence of lubrication oil intrusion into the compression chamber of the compressor which is liable to occur when negative pressure is produced in the compression chamber, is reduced.

BRIEF DESCRIPTION OF THE DRAWINGS

The invention will be described in greater detail with reference to certain preferred embodiments thereof and the accompanying drawings, wherein:

FIG. 6*a* to FIG. 6*d* are drawings for explaining the operation of a tooth type rotary compressor.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
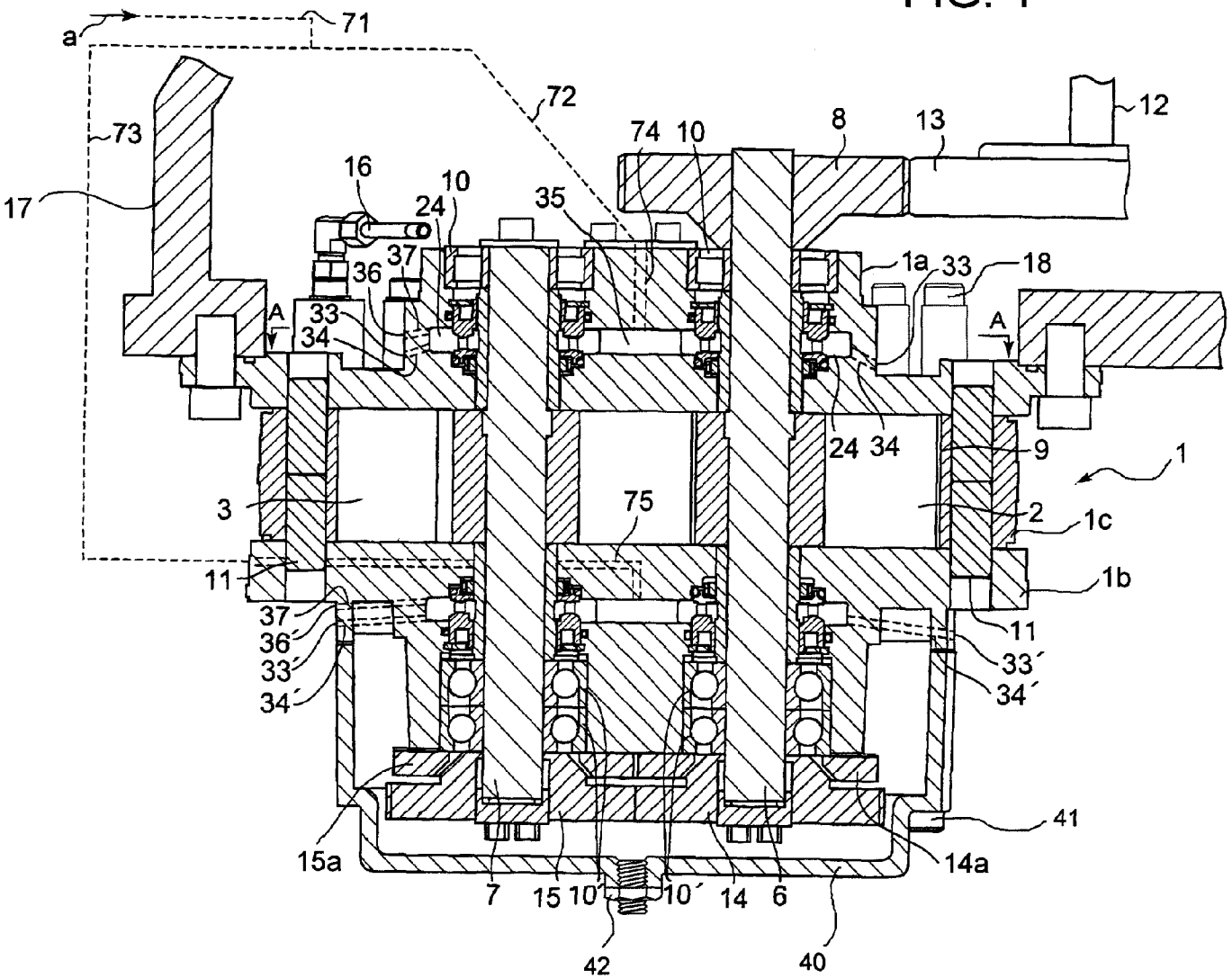
FIG. 1 is a longitudinal sectional view of a rotary compressor of which rotor shaft sealing structure of the invention is adopted.
Figure 2:
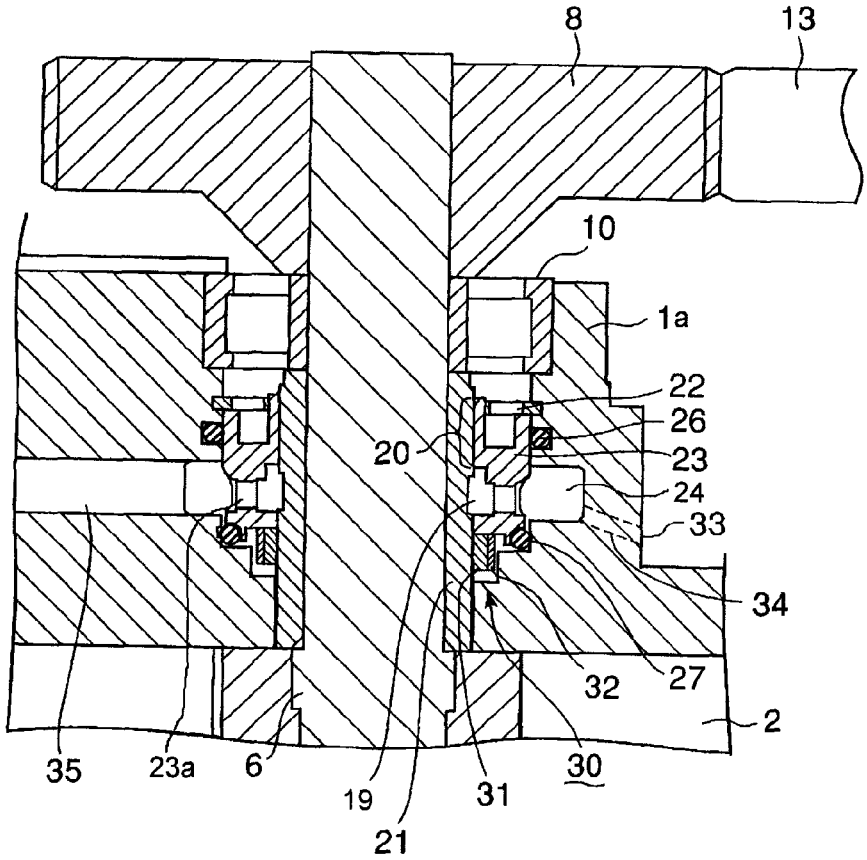
FIG. 2 is a partially enlarged section of FIG. 1.
Figure 3:
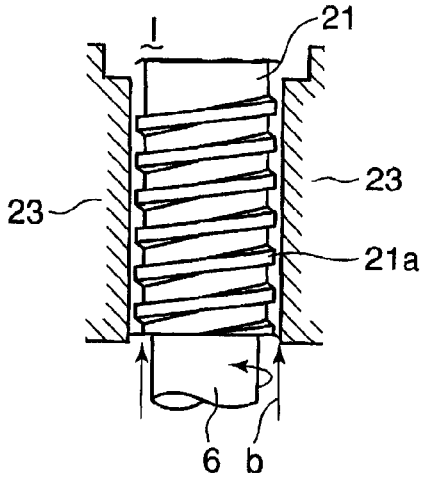
FIG. 3 is an enlarged sectional view of the viscoseal part of FIG. 1.
Figure 4:
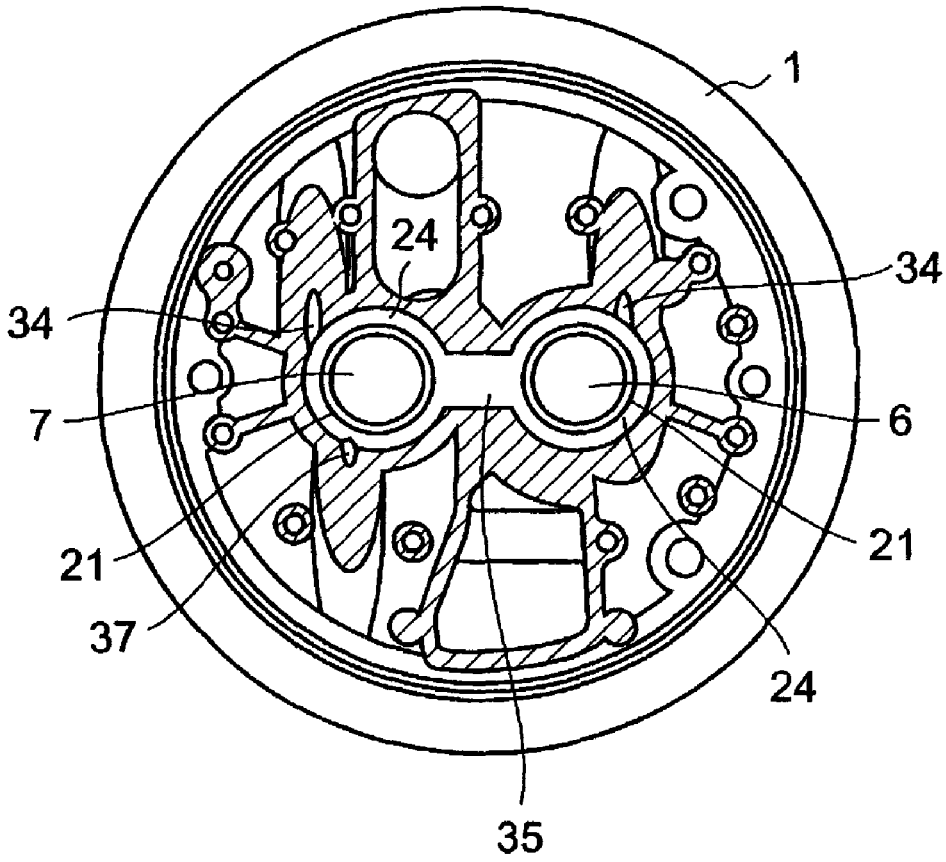
FIG. 4 is a sectional view along the line A-A in FIG. 1.

An embodiment of the invention will be explained with reference to FIGS. 1 to 4. FIG. 1 is a longitudinal sectional view of a tooth type rotary compressor of which rotor shaft sealing structure of the invention is adopted, FIG. 2 is a partially enlarged section of FIG. 1, FIG. 3 is an enlarged sectional view of the viscoseal part of FIG. 1, and FIG. 4 is a sectional view along the line A-A in FIG. 1.

Referring to FIG. 1, a male rotor 2 and a female rotor 3 are accommodated in a compression chamber 9 formed in a rotor casing 1 which is composed of an upper casing member 1*a*, a lower casing member 1*b*, and an intermediate casing member 1*c*. The rotors are center-aligned with dowel pins 11 and connected together by means of bolts 18. The male rotor 2 and female rotor 3 are respectively fixed to a male rotor shaft 6 and a female rotor shaft 7 supported rotatably by the upper and lower casing members 1*a* and 1*b* via bearings 10 and bearings 10'. Reference numerals 14*a* and 15*a* are cover plates for holding bearings 10'.

A gear 8 is fixed to one end of the male shaft 6. The gear 8 meshes with a gear 13 fixed to a rotation shaft 12 of an electric motor not shown in the drawing so that the male rotor 2 is driven by the electric motor. Timing gears 14 and 15 are attached to the lower end of the male rotor shaft 6 and the female rotor shafts 7 respectively so that both the rotors are rotated in synchronization in counter directions at the same rotation speed. The timing gears 14 and 15 are covered by a cover 40 bolted by bolts 41 to the lower casing member 1*b*, and a drain plug 42 is provided to the bottom of the cover 40.

Another tooth type rotary compressor not shown in the drawing is provided to the right of this tooth type rotary compressor and driven the electric motor via the gear 13. These two rotary compressors constitute a two-stage compressor unit comprised of a low pressure stage compressor and a high pressure stage compressor connected in series to produce high compression pressure. The two compressors are driven by said single electric motor not shown in the drawing, and the gears 8, 13 are located in a driving gear room covered by a gear casing 17 attached to the upper casing member 1*a*. Lubrication oil is supplied via an oil supply pipe 16 to the bearings 10' through oil passage not shown in the drawing and then flows out through gaps between the cover plates 14*a*, 15*a* and the timing gears 14, 15 to lubricate the teeth of the timing gears. The lubrication oil lubricated the bearings 10' and timing gears 14, 15 and fell down to the bottom of the cover 40 is drained through the drain pipe connected to the connector 42 to an oil tank not shown in the drawing.

Lubrication oil supplied to lubricate the gears 8 and 12 and fell down to upper surface of the upper casing member 1*a* is also drained to said oil tank through drain path not shown in the drawing.

Next, shaft sealing structure of the male and female rotor shafts 6 and 7 will be explained referring to FIG. 2 showing the sealing structure of the bearing part 10 of the male rotor 6 as a representative of the sealing structure. Sealing structure of the lower bearing parts 10' is similar to that and explanation is omitted. Referring to FIG. 2, an inner sleeve 21 is inserted tightly on the male rotor 6 between the bearing 10 and the rotor side end face of the upper casing member 1*a*. An outer sleeve 23 is received in a bore of the casing member 1*a* such that the outer surface of the outer sleeve 23 is sealed with O-rings 26 and 27, and the O-rings also serve to prevent the outer sleeve 23 from rotating by friction force exerting between O-rings and the outer sleeve 23 and the bore of the upper casing member 1*a*. A circular groove is formed in the upper casing member 1*a* such that an annular airspace 24 is formed to surround the outer surface of the outer sleeve between the O-rings 26, 27. The outer sleeve 23 has an inner grove 19 which is communicated by radial holes 23*a* of the outer sleeve 23 to the annual airspace 24. The inner groove 19 and the annular airspace 24 are horizontal when the rotor shafts 6 is vertical, and the bottom face of the annular space 24 is positioned a little lower than the bottom face of the annular groove 19 and the radial holes 23*a* communicate the inner groove 19 to the annular airspace 24 such that lubrication intruded into the inner groove 19 does not accumulate in the inner groove 19 but flows to the annular airspace 24 by gravity. Reference numeral 22 is a snap ring for restricting axial movement of the outer sleeve 23.

A viscoseal zone is formed between the outer surface of the inner sleeve 21 and the inner surface of the outer sleeve 23 along a range indicated by reference numeral 20. Referring to FIG. 3, on the outer surface of the inner sleeve 21 is formed a thread 21*a* in the range 20 and the top face of the thread does not contact with the inner surface of the outer sleeve 23. Lubrication oil after lubricating the bearing 10 fills the clearance between the thread 21*a* and the inner surface of the outer sleeve 23. The thread 21*a* is formed such that lubrication oil filled the clearance 21*a* is pressurized by screw pump effect of the thread 21*a* and forced upward (in direction b) by the rotation of the male rotor shaft 6. This action prevents lubrication oil from intruding into the inner groove 19.

Viscoseal effect can be obtained by forming a female thread on the inner surface of the outer sleeve 23 instead of forming the male thread 21*a* on the outer surface of the inner sleeve 21.

A contact type shaft seal 30 composed of a ring-shaped carbon seal 31 and an outer ring 32 made of metal is provided under the lower end of the outer sleeve 23. A communication hole 34 descending from the lower end face of the annular airspace 24 to an opening end 33 to communicate the annular airspace 24 to outside is provided in the upper casing member 1*a*. The annular airspace 24 is communicated to the inner groove 19 through the radial holes 23*a* of the outer sleeve 23 as mentioned before. The outside opening end 33 of the communication hole 34 is positioned at a position lower than the inner groove 19 so that lubrication oil leaked through the viscoseal zone to the inner groove 19 flows down through radial holes 23*a* and through the communication hole 34 into the gear room enclosed by the gear casing 17 and the upper casing member 1*a*.

As can be seen in FIG. 1 and FIG. 4, one communication hole 34 to communicate the annular airspace to the outside is provided for each of the annular airspaces 24 of the male and female rotor shaft sides, and further a between-rotor shaft communication passage 35 is provided in the upper casing member 1*a* to communicate the annular airspace 24 of the male rotor side to that of the female rotor side. The rotor shaft sealing structure at the under part of each of the male and female rotor shafts is similar to that of the above mentioned structure as can be seen in FIG. 1.

A communication hole 37 which is larger in diameter than that of the communication hole 34 is provided to communicate the annular airspace 24 of the female rotor shaft side to the outside such that the communicating hole 37 inclines downward as is the communication hole 34. Reference numeral 36 indicates the outside opening end of the communication hole 37. Even if the communication holes 34 are clogged by any cause, lubrication oil intruded into the inner groove 19 can be exhausted to the outside of the upper casing member 1*a* in the driving gear room covered by the gear casing 17.

Figure 5:
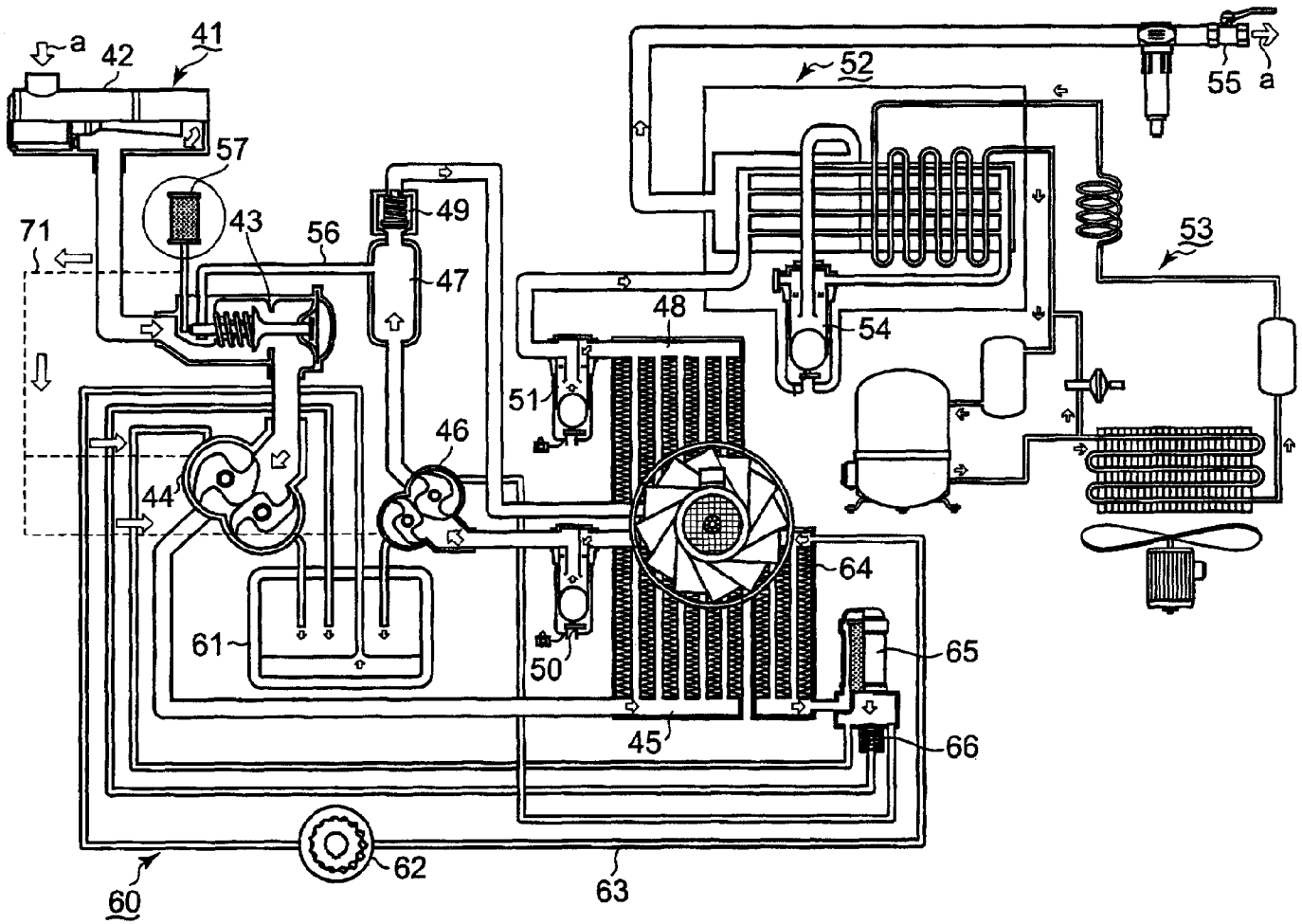
FIG. 5 is an example of compression system using compressors to which the rotor shaft sealing structure of the invention is applied.

Next, an example of compression system using tooth type rotary compressors shown in FIGS. 1~4 will be explained with reference to FIG. 5. Referring to FIG. 5, air a to be compressed is taken into the compression system through a filter 41 provided with a silencer 42. The air a is sucked into a low-pressure stage tooth type compressor 44 through a suction shut-off valve 43 to be compressed to 0.2 MPa for example. The air increased in temperature to about 200° C. by the compression is cooled by an intercooler 45.

The air cooled in the intercooler 45 is deprived of moisture by a moisture separator 50, then introduced into a high-pressure stage tooth type rotary compressor 46 to 0.7 MPa for example. The compressed air is alleviated in pulsation of pressure in a pulsation damper 47, then introduced to an aftercooler 48 through a check valve 49. The air compressed in the high-pressure stage compressor 46 and increased in temperature to about 200° C. is cooled by an aftercooler 48, deprived of moisture in a moisture separator 51, then sent to a refrigeration type air drier 52. The low-pressure stage compressor 44 and the high-pressure stage compressor 46 are tooth type rotary compressors according to the embodiment shown in FIGS. 1~4.

The air a is cooled in the refrigeration type air drier 52 by the refrigerant of a refrigerating machine 53, then moisture in the cooled air is removed in a moisture separator 54, then supplied via a supply valve 55 to an air tank not shown in the drawing.

In a lubricating oil system 60, lubrication oil in an oil tank 61 is supplied to the low-pressure stage and high-pressure stage compressors 44 and 46 by an oil pump 62 via oil pipe line 63. Lubrication oil sucked by the oil pump 62 from the oil tank 61 is sent to an oil cooler 64 to be cooled therein and then filtered through an oil filter 65 before supplied to the compressors. A bypass valve 66 is provided to the oil filter 65 to control lubricating oil flow to the compressors.

The compression system is usually operated with the supply valve 55 opened. When operating at no load, pressure rise in a delivery pipe to which the supply valve 55 is provided is detected and the shut-off valve 43 is closed based on the detected pressure rise by means of an electromagnetic valve (not shown in the drawing) connected to the shut-off valve 43. However, if the shut-off valve 43 is completely closed, there occurs abnormal noise, so the shut-off valve 43 is not completely closed but slightly opened so that a slight amount of air can flow through the valve.

The slight amount of air passed through the shut-off valve 43 is compressed through the low-pressure stage and high-pressure stage compressors 44 and 46 and returns to the suction shut-off valve 43 via a flow path 56. The slight amount of air returned to the shut-off valve 43 is usually released from a vent 57, but in the embodiment, a part or all of the air to be let out from the vent 57 is supplied to the shaft sealing parts of the compressors 44 and 46 through a pressurized air flow path 71.

In load operation, the flow path 56 is shut-off by opening action of the suction shut-off valve 43.

As shown in FIG. 1, air passages 74 and 75 are bored in both the casing members respectively for connecting the communication passages 35 to the outside. The pressurized air flow path 71 is connected to the air passages 74 and 75 via branch paths 72 and 73 respectively. The slight amount of air is pressurized usually to 0.1~0.2 MPa, positive pressure higher than atmospheric pressure. This pressurized air is supplied to the annular airspaces 24 of the rotor shaft sealing parts through the pressurized air flow paths 71~73, air passages 74 and 75 and the between-rotor shaft communication passage 35. The flow of the pressurized air to the annular spaces 24 can be controlled by providing a flow regulator valve in the pressurized air flow path 72 or 73.

When the compression system is in load operation, pressure in the compression chamber is positive and higher than the pressure in the gear room enclosed by the gear casing 17 and the upper casing member 1*a*, and compressed gas may slightly leaks through the contact type shaft seal 30 toward the inner groove 19. As the viscoseal 20 is provided between the bearing 10 and the inner groove 19, lubrication oil intruded into the viscoseal zone 20 is forced upward by the rotation of the male rotor shaft 6 as mentioned above and does not leaks into the inner groove 19. Therefore, ingestion of lubrication oil into the compression chamber 9 does not occur.

When the low-pressure stage and high-pressure stage compressors 44 and 46 are in no-load operation, the suction path is shut off by the suction shut-off valve 43, however in practice slightly opened to allow air to be slightly sucked, for if completely shut off there occurs abnormal noise. Negative pressure is produced in the compression chamber 9 in no-load operation of the compressor. Therefore, there is fear that air is ingested from the inner groove 19 through the contact type shaft seal 30 to the compression chamber 9, which tends to reduce pressure in the inner groove 19 resulting in decreased oil seal effect of the viscoseal 20. According to the embodiment, pressurized air is introduced to the annular airspaces 24 from the suction shut-off valve 43 through the pressurized air flow path 71, bypass paths 72, 73, air passages 74, 75 and communication passages 35 in the casing members 1*a*, 1*b*, and flows out through the communicating holes 34, 34' to the outside of the casing members 1*a*, 1*b*. Therefore, if there is leaked lubrication oil in the inner grooves 19 and annular airspaces 24, it is taken away to the outside of the rotor casing 1 by the pressurized air.

Negative pressure propagated from the compression chamber 9 is interrupted by the positive pressure in the inner grooves 19, not to be propagated to the bearing sides 10, 10'.

Therefore, there is little fear that lubrication oil is ingested into the compression chamber 9. Thus, positive pressure in the annular spaces 24 serve to interrupt negative pressure produced in the compression chamber when the compressors are operated at no load, and intrusion of lubrication oil into the compression chamber 9 is prevented.

Lubrication oil may intrude into the inner groove 19 when operation of the compressor is stopped. The lubrication oil intruded into the inner groove 19 is taken out by the pressurized air through the radial holes 23*a* of the outer sleeve 23, the annular airspace 24, and the downward inclining communication hole 34 to the outside of the upper casing member 1*a*. As communication hole 34 is also provided for annular airspace 24 of female rotor side and the annular airspace of female rotor side is connected with the communication passage 35, even when one of the communication hole is clogged by any cause, the lubrication oil can be taken out to the outside of the upper casing member 1*a* through the other communication hole.

Shaft sealing structure and its action were explained above concerning those of the upper casing member side rotor shaft sealing part.

The rotor shaft sealing parts of the lower casing member side bearing part corresponding to those of the upper casing member side bearing part are designated by reference numerals affixed with ' mark, and the structure is similar to that of the upper casing member side rotor shaft sealing part except that the communication holes 34' of the lower casing member 1*b* are opened to atmosphere and that the viscoseal is composed to force the lubrication oil intruded into the viscoseal zone downward as the rotor shaft rotates.

Action of the shaft sealing structure of the lower casing member side rotor shaft sealing part is similar to that of the upper casing member side rotor shaft sealing part.

As the communication holes 34' are opened to atmosphere, there is fear that the communication holes 34' are clogged by dust in atmosphere, and provision of a communication holes 37' larger in diameter is particularly preferable.

In the embodiment of the shaft sealing structure, a case the rotary compressor is installed so that the rotor shafts extend vertically is explained. It is applicable when the rotary compressor is installed so that the rotor shafts 6, 7 extend horizontally. In this case, it is preferable that the communication hole 34 and 34' are provided only to down side rotor shaft sealing parts of the casing members 1*a* and 1*b* respectively. As the annular airspaces 24 in the casing members 1*a* and 1*b* are connected to those of the upper side rotor shaft sealing parts of the casing members 1*a* and 1*b* by the communicating passages 35 respectively, lubrication oil leaked through the viscoseal zone 20 of each of the upper side rotor shaft sealing parts falls down through each communicating passage 35 to the annular airspace of each of the down side rotor shaft sealing parts and exhausted to outside of the casing member 1*a* in the driving gear room covered by the gear casing 17 and to the outside of the casing member 1*b* to the atmosphere respectively.

In the compression system of FIG. 5, pressurized air is taken out from the suction shut-off valve 43 when the system is in no-load operation. It is also suitable to provide a separate pressurized air supplier such as an air tank to which pressurized air compressed by the system is supplied. Further, pressurized air may be taken out directly from the pulsation damper 47 or from the air duct connecting the low-pressure stage compressor 44 to the high-pressure stage compressor 46. In these cases, pressurized air can be supplied to the annular airspaces 24 not only in no-load operation but in load operation of the system, and excellent sealing effect can be expected always in operation of the system.

INDUSTRIAL APPLICABILITY

According to the invention, rotor shaft sealing structure of an oil-free rotary compressor is provided with which occurrence of lubrication oil intrusion into the compression chamber of the compressor which is liable to occur when negative pressure is produced in the compression chamber, is prevented by providing an annular airspace between the oil lubricated bearing side seal means and compression chamber side seal means and supplying pressurized air to the annular airspace communicated to the outside of the rotor casing.

This application is based on, and claims priority to, Japanese Patent Application No: 2007-95583, filed on Mar. 30, 2007. The disclosure of the priority application, in its entirety, including the drawings, claims, and the specification thereof, is incorporated herein by reference.

The invention claimed is:

1. A rotor shaft sealing structure of an oil-free rotary compressor having a pair of male and female rotors accommodated in a compression chamber formed by a rotor casing, each rotor having a rotor shaft extending from both end faces of the rotor to penetrate both side walls of the rotor casing to be supported by the rotor casing via oil lubricated bearings by both the side walls of the rotor casing, the rotor shaft sealing structure comprising:

a rotor shaft sealing part comprising two shaft seals provided at each of rotor shaft bearing parts between the bearing and the compression chamber such that an annular airspace is formed between the shaft seals; and a pressurized air supplier that supplies pressurized air to each of the annular airspaces formed between the shaft seals provided at each of the rotor shaft bearing parts;

wherein at least one communicating hole for communicating each annular airspace to the outside of the rotor casing is provided such that the communicating hole opens at a bottom part of the annular airspace to communicate the annular airspace to the outside of the rotor casing, and each of the annular airspaces of the male rotor shaft sealing parts and each of those of the female rotor shaft sealing parts are connected by a between-rotor shaft communication passage respectively so that pressurized air supplied to each annular airspace of one of the rotor shaft sealing parts is supplied to each annular airspace of the other rotor shaft sealing part; and wherein pressurized air passages are formed in the rotor casing that respectively connect to said between-rotor shaft communication passages and the pressurized air supplier supplies air to each of the annular airspaces through the pressurized air passages.

2. A rotor shaft sealing structure of an oil-free rotary compressor having a pair of male and female rotors accommodated in a compression chamber formed by a rotor casing, each rotor having a rotor shaft extending from both end faces of the rotor to penetrate both side walls of the rotor casing to be supported by the rotor casing via oil lubricated bearings by both the side walls of the rotor casing, the rotor shaft sealing structure comprising:

a rotor shaft sealing part comprising two shaft seals provided at each of rotor shaft bearing parts between the bearing and the compression chamber such that an annular airspace is formed between the shaft seals; and a pressurized air supplier that supplies pressurized air to each of the annular airspaces formed between the shaft seals provided at each of the rotor shaft bearing parts;

wherein at least one communicating hole for communicating each annular airspace to the outside of the rotor casing is provided such that the communicating hole opens at a bottom part of the annular airspace to communicate the annular airspace to the outside of the rotor casing, and each of the annular airspaces of the male rotor shaft sealing parts and each of those of the female rotor shaft sealing parts are connected by a between-rotor shaft communication passage respectively so that pressurized air supplied to each annular airspace of one of the rotor shaft sealing parts is supplied to each annular airspace of the other rotor shaft sealing part;

wherein pressurized air passages are formed in the rotor casing that respectively connect to said between-rotor shaft communication passages and the pressurized air supplier supplies air to each of the annular airspaces through the pressurized air passages; and wherein a suction shut-off valve for shutting off, when the compressor is operated under a no-load condition, a suction path which connects to the inlet of the compressor is provided, the suction shut-off valve being composed such that, when the valve is slightly opened to allow a slight amount of air to be sucked into the compressor when the compressor is operated under the no-load condition, the slight amount of air pressurized by the compressor is allowed to flow to said pressurized air passages via an air flow path connecting to the pressurized air passages by opening the air flow path by shutting-off movement of the suction shut-off valve.

* * * * *